US010290930B2

(12) United States Patent
Blackadder et al.

(10) Patent No.: US 10,290,930 B2
(45) Date of Patent: May 14, 2019

(54) CROSSED DIPOLE WITH ENHANCED GAIN AT LOW ELEVATION

(71) Applicant: Honeywell International Inc., Morris Plains, NJ (US)

(72) Inventors: Hugh Adam Stuart Blackadder, Gloucester (CA); Sergiy Borysenko, Ottawa (CA); Peter Charles Strickland, Ottawa (CA)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/653,062

(22) Filed: Jul. 18, 2017

(65) Prior Publication Data

US 2019/0027815 A1 Jan. 24, 2019

(51) Int. Cl.
*H01Q 1/28* (2006.01)
*H01Q 21/26* (2006.01)

(52) U.S. Cl.
CPC ..... *H01Q 1/28* (2013.01); *H01Q 21/26* (2013.01)

(58) Field of Classification Search
CPC ..... H01Q 1/28; H01Q 21/26
USPC ..... 343/878
See application file for complete search history.

(56) References Cited

U.S. PATENT DOCUMENTS 3,541,559 A 11/1970 Evans
4,700,197 A 10/1987 Milne
6,069,590 A 5/2000 Thompson, Jr. et al.
6,211,840 B1 4/2001 Wood et al.
6,734,829 B1 5/2004 Gottl
8,462,071 B1 6/2013 Rudish et al.
2002/0158808 A1 10/2002 Inoue
2004/0155831 A1 8/2004 Goebel et al.
2007/0146225 A1 6/2007 Boss et al.
2010/0007572 A1* 1/2010 Jones ..... H01Q 9/28 343/798
2010/0060513 A1 3/2010 Henderson
(Continued)

FOREIGN PATENT DOCUMENTS

WO 2017020114 A1 2/2017

OTHER PUBLICATIONS

Fine, "VHF-UHF Aircraft Antenna", "NRL Report 8012", Jul. 23, 1976, pp. 1-33, Publisher: Naval Research Laboratory, Published in: Washington D.C.

(Continued)

*Primary Examiner* — Andrea Lindgren Baltzell
(74) *Attorney, Agent, or Firm* — Fogg & Powers LLC

(57) ABSTRACT

An antenna system is provided that includes at least one driven radiator element and at least one coupling device. The at least one driven radiator element is disposed above a printed circuit board. The at least one coupling device has a step feature in at least one of width and diameter. A smaller of the at least one of the width and diameter is received in at least one of a via and slot in the printed circuit board. The at least one coupling device is oriented nominally orthogonal to a plane of the printed circuit board. The at least one solder joint couples the at least one coupling device to the printed circuit board. At least one ground plane layer is electrically connected to the at least one coupling device by at least one of the solder joint and the at least one of a via and a slot.

20 Claims, 10 Drawing Sheets

(56) References Cited

U.S. PATENT DOCUMENTS

2014/0118191 A1* 5/2014 Smith ..... H01Q 19/30
342/372

OTHER PUBLICATIONS

European Patent Office; "Extended European Search Report from EP 18183567.9, dated Dec. 18, 2018"; from Foreign Counterpart of U.S. Appl. No. 15/653,062; pp. 1-9; dated Dec. 14, 2018; Published: EP.

* cited by examiner

CROSSED DIPOLE WITH ENHANCED GAIN AT LOW ELEVATION

CROSS-REFERENCE TO RELATED APPLICATIONS

Background

The performance of aeronautical satellite communications systems is often impeded in northern or southern latitudes by the relatively poor gain of the aircraft antenna systems at low elevation angles. In particular, a low profile circularly polarized antenna on top of a fuselage typically has low gain towards the horizon. This can result in low throughput, or loss of connectivity, at the edges of the satellite footprint and/or if the aircraft rolls or pitches. This is a problem for both omnidirectional antennas and phased array designs.

SUMMARY

The following summary is made by way of example and not by way of limitation. It is merely provided to aid the reader in understanding some of the aspects of the subject matter described. Embodiments provide an antenna system with enhance gain at low elevations with the use of one or more coupling devices.

In one embodiment, an antenna system is provided. The antenna system includes a printed circuit board, at least one driven radiator element, at least one coupling device, at least one solder joint and at least one ground plane layer. The at least one driven radiator element is disposed above the printed circuit board. The at least one coupling device has a step feature in at least one of width and diameter. A smaller of the at least one of the width and diameter of the at least one coupling device is received in at least one of a via and slot in the printed circuit board. The at least one coupling device is oriented nominally orthogonal to a plane of the printed circuit board. The at least one solder joint couples the at least one coupling device to the printed circuit board. The at least one ground plane layer is electrically connected to the at least one coupling device by at least one of the solder joint and the at least one of a via and a slot.

In another example embodiment, an antenna system with enhance gain at low elevations is provided. The antenna system includes at least one driven radiator element, at least one coupling device and displacer material. The at least one driven radiator element is coupled to a printed circuit board. The at least one coupling device is associated with each driven radiator element. Each coupling device includes a first end and a second end. The first end is coupled to at least one ground layer through a connecting passage of the printed circuit board. The at least one coupling device is received with a cavity of the displacer material. The second end of the coupling device is attached to the displacer material.

In yet another embodiment, an antenna system with enhance gain at low elevations is provided. The antenna system includes a plurality of cross-dipole elements, a plurality of coupling devices, at least one solder joint and displacer material. The plurality of cross-dipole elements form an array of radiating elements that are coupled to a printed circuit board. The plurality of coupling devices are associated with each cross-dipole element. Each coupling device has a first end and a second end. Each coupling device further has a step feature in at least one of width and diameter. A smaller of the at least one of the width and diameter proximate the first end of each coupling device is received in a connection passage in the printed circuit board. The at least one solder joint couples each coupling device to a connection pad associated with a connection passage of the printed circuit board. The at least one coupling device is received within a cavity of the displacer material. The second end of each coupling device is attached to the displacer material.

BRIEF DESCRIPTION OF THE DRAWINGS

In accordance with common practice, the various described features are not drawn to scale but are drawn to emphasize specific features relevant to the subject matter described. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the embodiments, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments provide driven radiator elements such as crossed dipole elements with at least one coupling device (coupling post) that may be used in an antenna system to enhance gain at low elevations. These embodiments may be especially helpful for aircraft antenna systems at low elevation angles. In an embodiment, coupling devices are added proximate each driven radiator element. In an embodiment, the coupling devices are soldered into a ground plane of a circuit board. However, other support and/or termination are used in other embodiments. In one embodiment the coupling devices are oriented symmetrically about a crossed-dipole element. For example, 90 degree symmetry works well in an embodiment, however other periodicity and aperiodicity configuration are also effective and used in other embodiment. Moreover, in other embodiments, symmetry is not essential. In an embodiment, the coupling devices are shorter than one quarter wavelength. The coupling devices may be on a single ring, multiple rings, or not constrained to rings. In the case of a phased array these coupling devices may be interspersed within the array and need not necessarily follow the array periodicity. Post cross-section may be square, circular, rectangular or other. Moreover, in an embodiment, the maximum cross-sectional dimension of a coupling devices may be less than one quarter wavelength. Embodiments of the antenna system may be attached externally to a fuselage of an aircraft to be used as part of the aircrafts antenna system. However, its application is not limited to aircraft systems.

Figure 1:
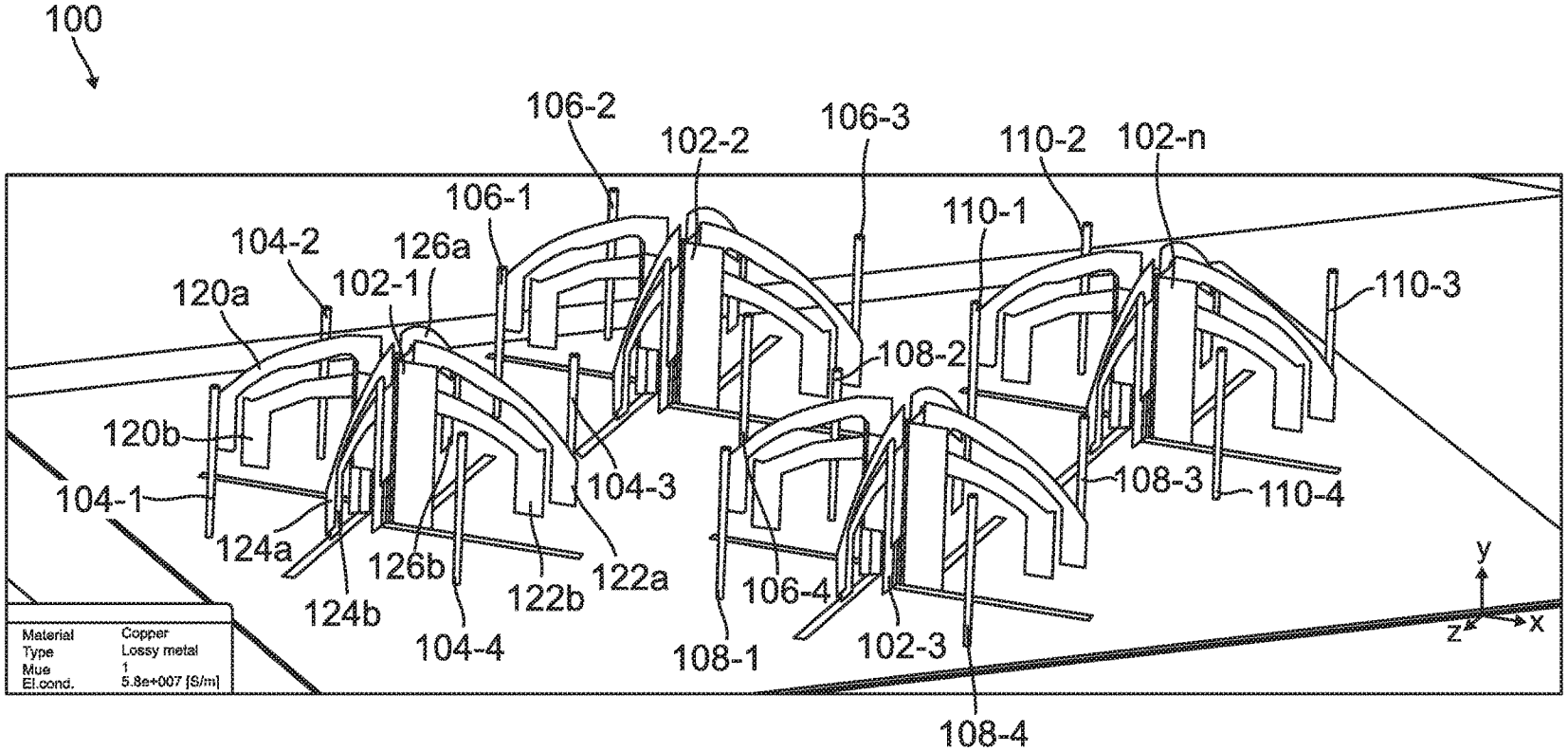
FIG. 1 is an illustration of a portion of a high power, low noise, diplexer low gain antenna (HELGA) system with coupling devices according to one exemplary embodiment.

Referring to FIG. 1, an antenna system 100 of an embodiment is illustrated. In particular, antenna system 100 is part of a high power, low noise, diplexer low gain antenna (HELGA) with coupling devices in this example embodiment. The antenna system 100 includes a plurality of driven radiators 102-1 through **102-*n*. In this embodiment, the driven radiators are crossed-dipole antenna elements 102-1 through 102-*n*. The crossed dipoles elements 102 of FIG. 1, are in one embodiment, made of eight arms 120*a*, 120*b*, 122*a*, 122*b*, 124*a*, 124*b* 126*a* and 126*b*. Further in one embodiment four of the arms are driven (arms 120*b*, 122*b*, 124*b* and 126*b*) and four of the arms are passive (arms 120*a*, 122*a*, 124*a* and 126*a*). As illustrated in FIG. 1, the driven radiators 102-1 through 120-*n* may be positioned in an array of driven element radiators in a symmetric arrangement. The driven radiators 102-1 through 120-*n*** may also be an asymmetric arrangement. The driven radiators in embodiments may be positioned on a nominally hexagonal grid and a rectangular grid.

In the example of FIG. 1, a plurality of coupling devices are positioned proximate each crossed-dipole element 102-1 through **102-*n*. For example, coupling devices 104-1 through 104-4 are positioned proximate crossed dipole elements 102-1, posts 106-1 through 106-4 are positioned proximate crossed-dipole 102-3, posts 108-1 through 108-4 are positioned proximate crossed-dipole element 102-3 and coupling devices 110-1 through 110-4 are positioned proximate crossed-dipole 102-*n*. In this example embodiment, the coupling devices (generally designated as 104) are orientated symmetrically about a respective cross-dipole (generally designated as 102**). In this example, a 90 degree symmetry is used. However, as discussed above, other periodic and aperiodic arrangements are also effective and used in other embodiments.

Figure 2A:
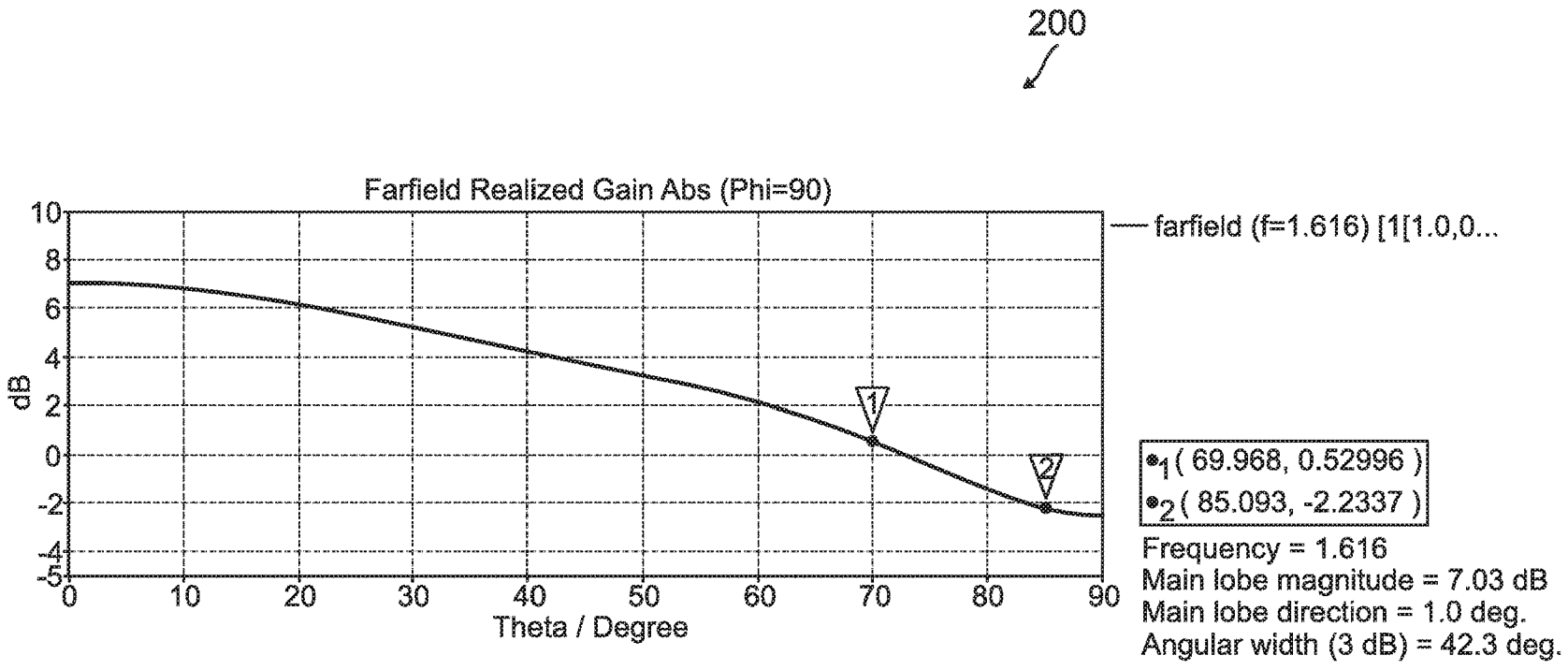
FIG. 2A is a gain plot without coupling devices of the prior art.
Figure 2B:
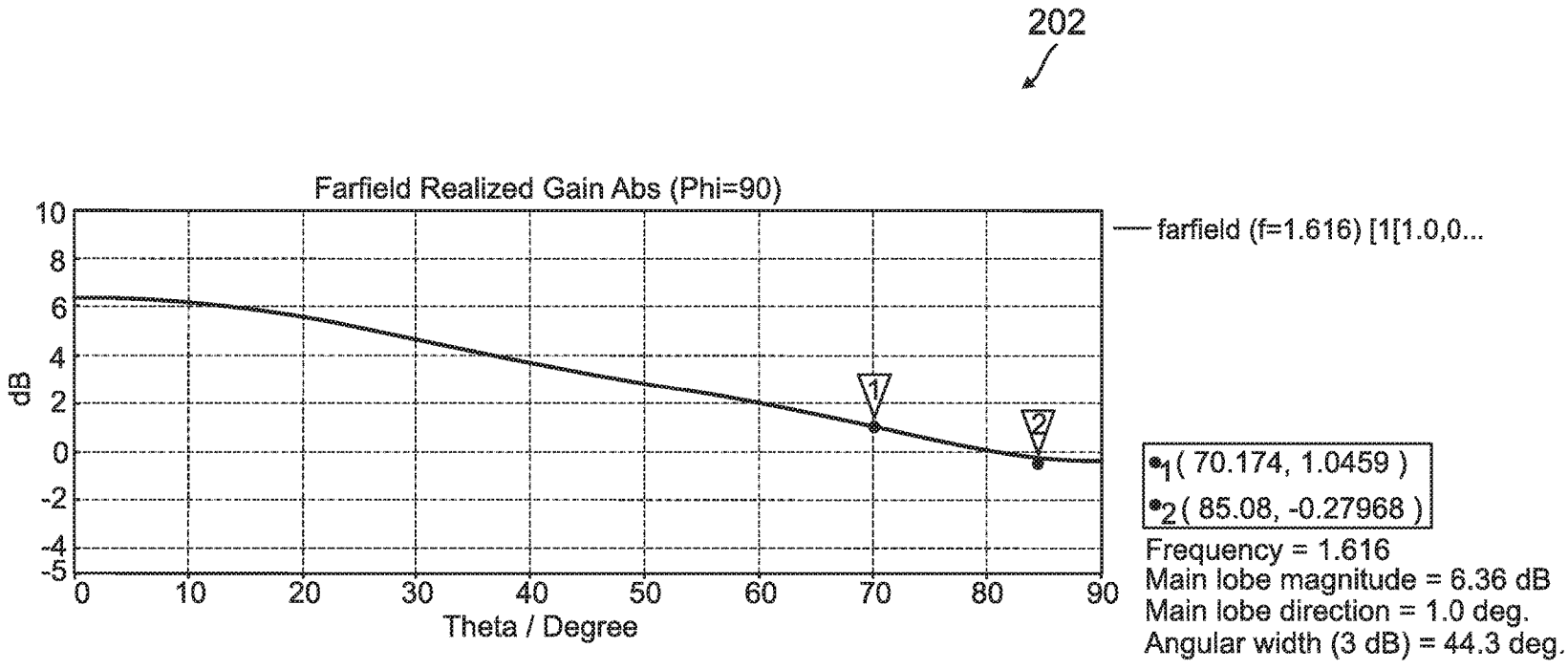
FIG. 2B is a gain plot with coupling devices of an exemplary embodiment.

The use of coupling devices as described above have effects on gain of the antenna system. For example, FIG. 2A illustrates gain plot 200 of an antenna without the use of coupling devices while FIG. 2B illustrates the gain plot 202 of the same antenna with the use of coupling devices. The plots 200 and 202 illustrate enhanced realized gains for the antenna with coupling devices at higher degrees.

Figure 3:
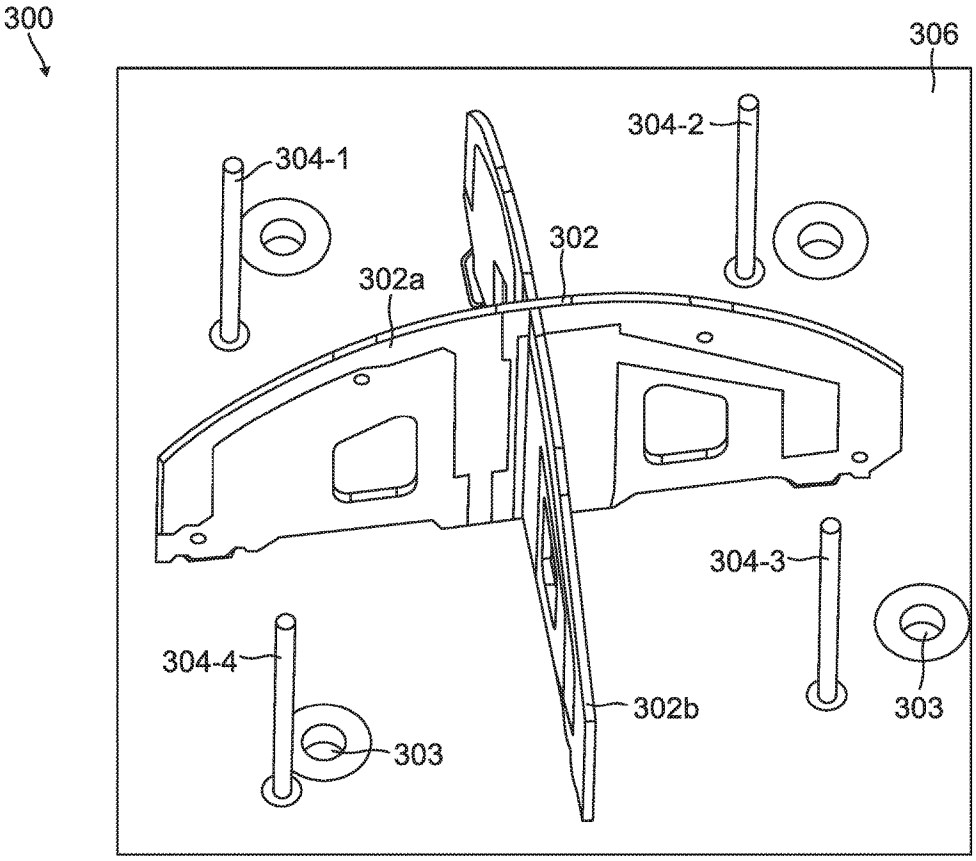
FIG. 3 is a side perspective view of a cross-dipole element and coupling devices according to one exemplary embodiment.

Referring to FIG. 3, a side perspective view of a crossed-dipole element 302 with four associated coupling devices 304-1, 304-2, 304-3 and 304-4 of an exemplary embodiment is illustrated. The cross-dipole element 302 includes a first portion **302*a* (first arm) and a second portion 302*b* (second arm) mounted on a printed circuit board 306 (printed circuit card). As illustrated, the second portion 302*b* extends through a central point of the first portion 302*a* in a perpendicular fashion to form the cross configuration of the crossed dipole element 302. Also illustrated in this example embodiment is that the first and second arms 320*a* and 302*b* have a higher central height where they cross than at ends of the arms 320*a* and 302*b*. The coupling devices 304-1, 304-2, 304-3 and 304-4 are positioned in a symmetrical orientation in relation to the crossed-dipole element 302 in this example embodiment. Also illustrated in FIG. 3 are unused connection pads 303 of the printed circuit board 306**.

Figure 4:
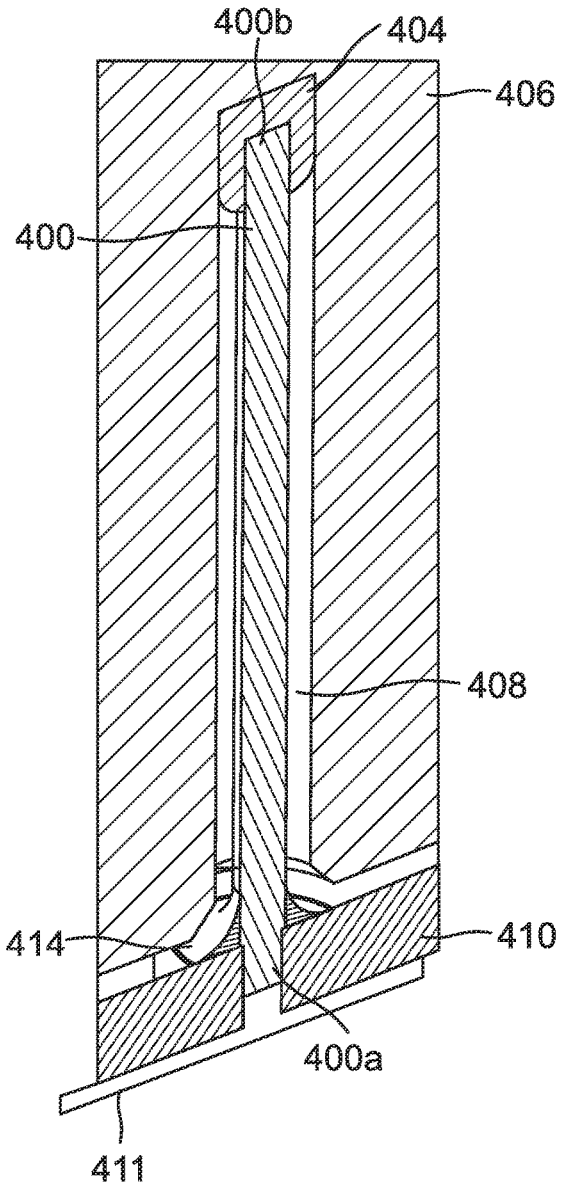
FIG. 4 is a cross-sectional side perspective view of a coupling device of one exemplary embodiment.

An example of a coupling device 400 (coupling post) of an example embodiment is illustrated in the cross-sectional side perspective view of FIG. 4. The coupling device 400 is a conductive element, such as but not limited to, a copper post that is received in a cavity 408 of displacer material 406. In one embodiment, the displacer material 406 is a foam air displacer 406. A first end **400*a* of the coupling device 400 is soldered to a printed circuit card 410 (or printed circuit board) to form a solder joint 414. In an embodiment, a first end 400*a* of the coupling device 400 is connected to at least one ground plane layer 411 through via 409. In the example embodiment of FIG. 4, the conductive element is stabilized within the cavity 408 with an adhesive 404 that couples a second end 400*b* of the coupling device 400 to the foam air displacer 406. In one embodiment, the adhesive is initially a wet adhesive that subsequently cures. The adhesive 404 acts as a physical restraint between the second end 400*b* of the coupling device 400 and the foam air displacer 406. The physical restraint on the second end 400*b* of the coupling device 400 provides support and limits stress on the lower solder joint 414**.

Figure 5:
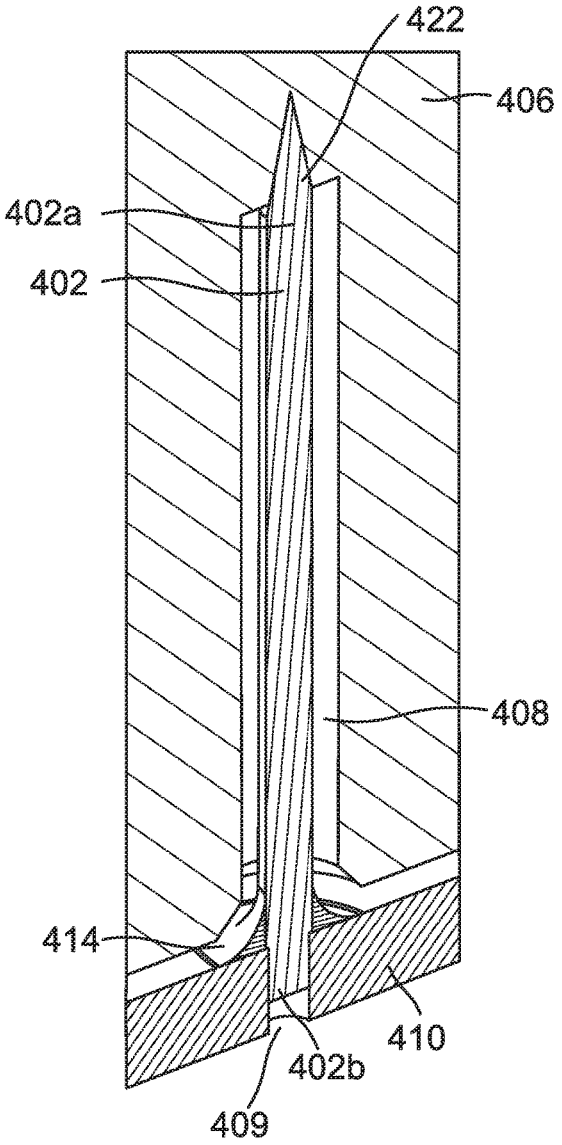
FIG. 5 is a cross-sectional side perspective view of a coupling device of yet another exemplary embodiment.
Figure 6:
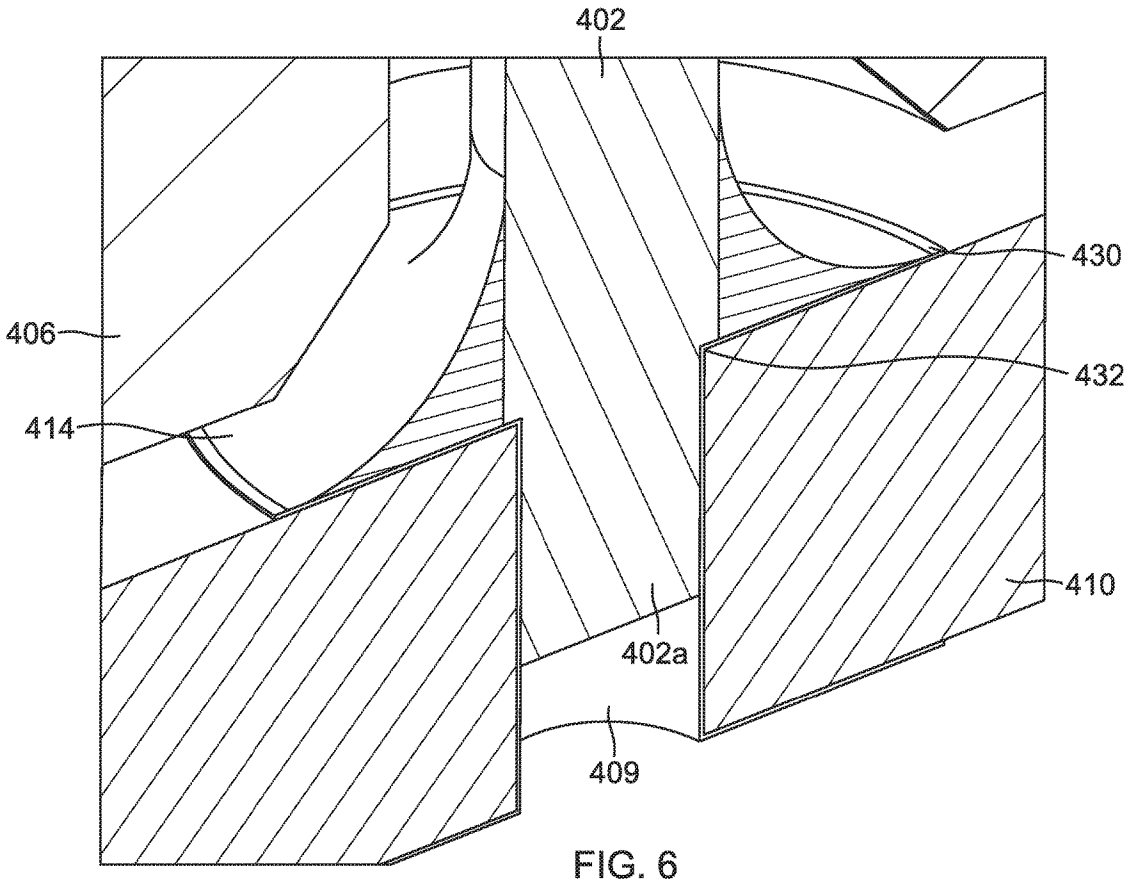
FIG. 6 is a close up side perspective view of a portion of the coupling device of FIG. 5.

FIG. 5 illustrates another example embodiment of a coupling device 402. This embodiment has a similar first end **402*a* that is soldered to a printed circuit card 410. However, in this embodiment, the second end 422 of the coupling device 420 includes a sharp tip end 422 that is designed to pierce an upper ceiling of the cavity 408 in the foam air displacer 406. Hence, in this embodiment, the sharp tip end 422 received within the foam air displacer 406 restrains the sharp tip end 422 to the displacer 406 to provided support of the coupling device 402 and limit the stress on the lower solder joint 414. FIG. 6 illustrates a close up view of the first end 402*a* of the coupling device 402, positioned in the via 409 and coupled to the printed circuit card 410. FIG. 6 illustrates the solder fillet that forms the lower solder joint 414 to couple the coupling device 402 to the printed circuit card 410. In particular, the lower solder joint 414 coupled the coupling device 402 to coupling pad 430 of the printed circuit card 410. In some embodiments the coupling device 402 include a step feature 432 proximate the first end 402*a*. The step feature 132 allows for accurate assembly positioning of the coupling device 402 on the print circuit card 410 prior to and during soldering operations. In an embodiment, wherein the coupling device 402 is in a cylindrical shape, the step feature 132 is formed by a decrease in diameter of the coupling device 402 about the first end 402*a*. This decrease in diameter approximate the first end 420*a* of the coupling device 402 creates a ledge (or step) that is positioned to engage a portion of the coupling pad 430 while the remainder of the first end 402*a* of the coupling device 402 is received within a coupling passage 412 of the coupling pad 430. As discussed above, the first end 402*a* of the coupling device 402** in embodiments would be coupled to a ground plane connection (not shown).

Figure 7:
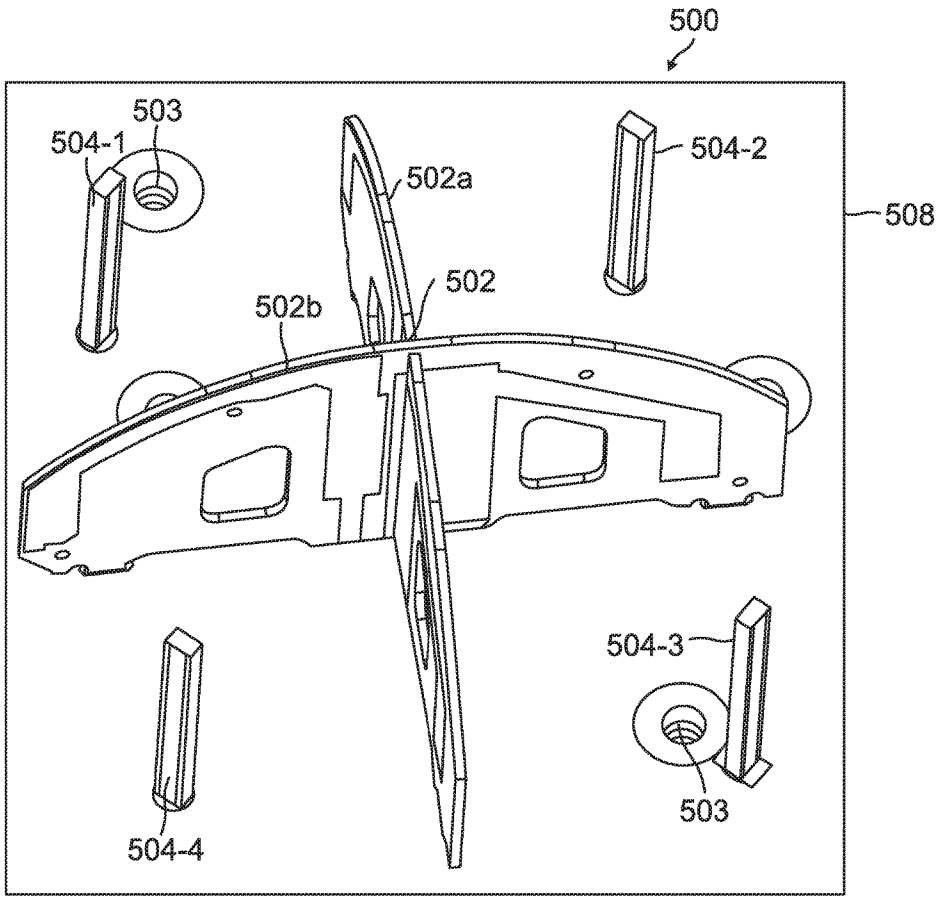
FIG. 7 is a side perspective view of a cross-dipole element and associated coupling devices of another exemplary embodiment.

Another example of an antenna element 500 of an antenna system is illustrated in FIG. 7. In this embodiment, the coupling devices 504-1 through 504-4 include a base post 520 and a conductive trace 522 discussed further below. The coupling devices 504-1 through 504-4 in this example embodiment are symmetrically positioned in relation to an associated crossed-dipole element 502. The crossed-dipole element 502 includes a first portion 502*a* that centrally extends through a second portion 502*b* in a perpendicular fashion to form a cross configuration. Each coupling member (generally designated as 504) is positioned between a section of the first portion 502*a* and a section of the second portion 502*b* of the cross-dipole 502. The coupling devices 504-1 through 504-4 and the cross-dipole 502 are coupled to a printed circuit board card 508. The print circuit board card 508 includes a plurality of connection pads 503.

Figure 8B:
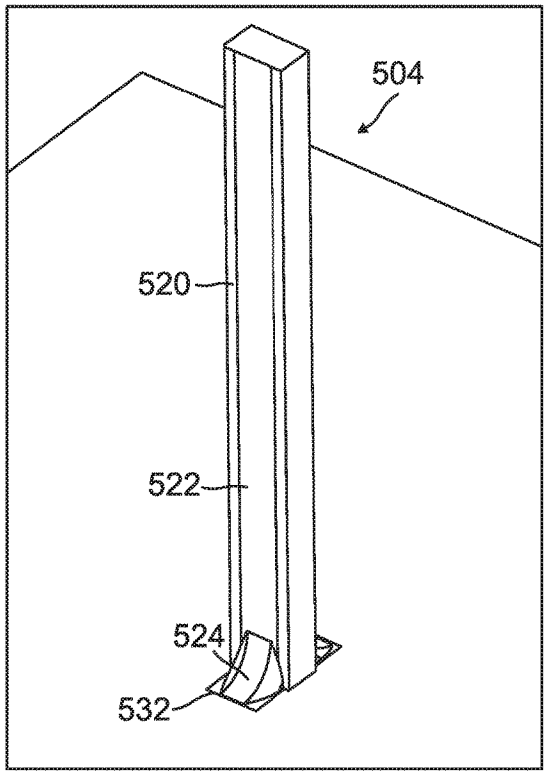
FIG. 8B is a side perspective view of the coupling device of FIG. 8A coupled to the printed circuit board of an exemplary embodiment.
Figure 8A:
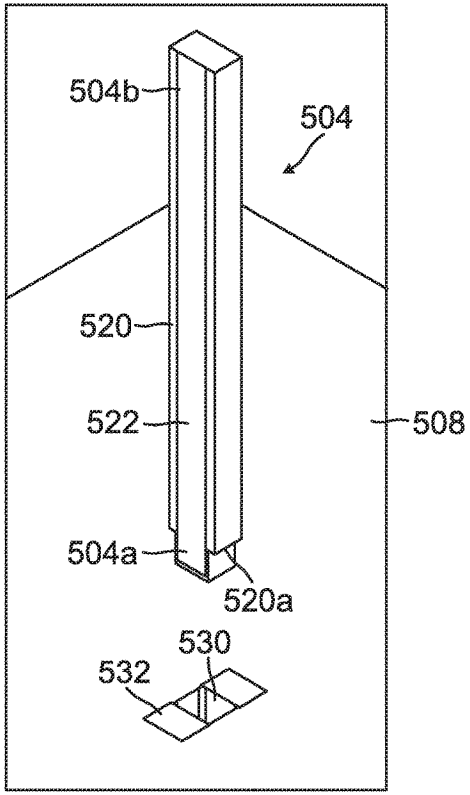
FIG. 8A is a side perspective view of a coupling device aligned to be coupled to a printed circuit board of an exemplary embodiment.
Figure 9:
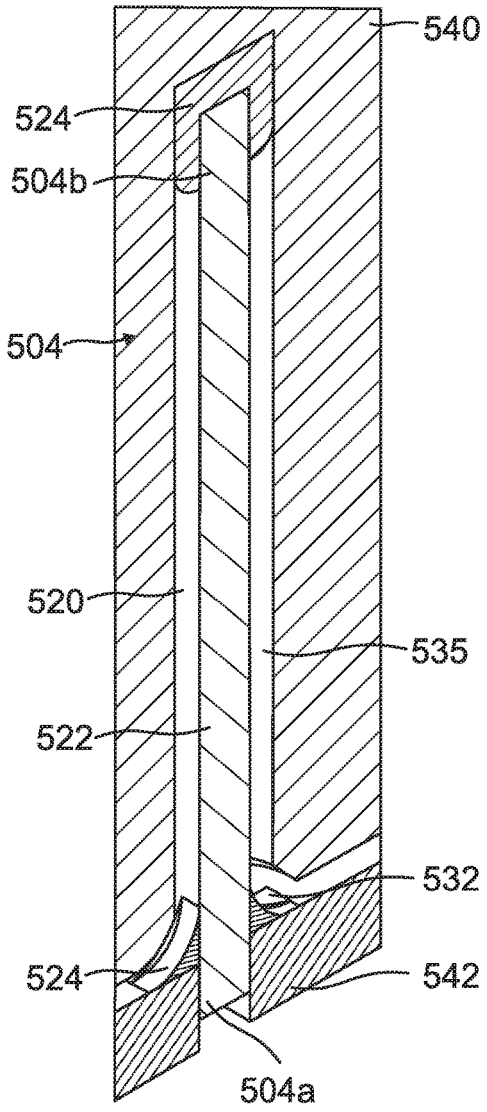
FIG. 9 is a cross-sectional side view of the coupling device coupled to the printed circuit board of FIG. 8B.

FIG. 8A is a side perspective view of a coupling member 504 being positioned for attachment to a printed circuit board card 508. As discussed above, the coupling member 504 in this example embodiment includes a base post 520 and a conductive trace 522. The base post 529 in an embodiment, may be made from a glass/epoxy or other know printed circuit board laminate material. The conductive trace 522 in an embodiment, is copper trace on a printed circuit board. The coupling member 504 includes a first end 504*a* and a second end 504*b*. The base post 520 in this embodiment include a step element 520*a* that is designed to align the position of the coupling member 504 in relation to the printed circuit board card 504 during coupling. The step element 520*a* in this embodiment, is formed by a reduction in thickness of the base post 520 proximate the first end 504*a* of the coupling member 504. Further illustrated in FIG. 8A is a connection slot 530 and connection pad 532 of the printed circuit card 508. The first end 504*a* of the coupling member 504 is received within the connection slot 530 of the printed circuit card 508. As illustrated in FIG. 8B, solder joints 524 are formed to couple the conductive trace 522 to the connection pad 532 of the printed circuit card 508. FIG. 9 illustrates a cross-sectional side perspective view of coupling member 504. As illustrated, in this example embodiment, the coupling member 504 is positioned within a cavity 535 of displacer material 540. The displacer material 540 being a foam air displacer 540 in one embodiment. In this embodiment, the second end 504*b* of the coupling member 504 is coupled to a ceiling portion of the cavity 535 of the displacer material 540 via adhesive 524. In one embodiment, the adhesive is initially applied in a wet state that subsequently cures. The adhesive 524 acts as a physical restraint of the second end 504*b* of the coupling member 504. This supports the coupling device 504 and limits stress on the lower solder joint 524.

EXAMPLE EMBODIMENTS

Example 1 is an antenna system. The antenna system includes a printed circuit board, at least one driven radiator element, at least one coupling device, at least one solder joint and at least one ground plane layer. The at least one driven radiator element is disposed above the printed circuit board. The at least one coupling device has a step feature in at least one of width and diameter. A smaller of the at least one of the width and diameter of the at least one coupling device is received in at least one of a via and slot in the printed circuit board. The at least one coupling device is oriented nominally orthogonal to a plane of the printed circuit board. The at least one solder joint couples the at least one coupling device to the printed circuit board. The at least one ground plane layer is electrically connected to the at least one coupling device by at least one of the solder joint and the at least one of a via and a slot.

Example 2, includes the antenna system of Example 1, wherein the antenna system is circularly polarized.

Example 3 includes the antenna system of any of the Examples 1-2, wherein the at least one driven radiator element is at least one a crossed-dipole element.

Example 4 includes the antenna system of Example 3, wherein the at least one crossed-dipole element has four active arms and four passive arms.

Example 5 includes the antenna system of any of the Examples 1-4, wherein the at least one coupling device has one of a nominally circular cross-section and a rectangular cross section.

Example 6 includes the antenna system of any of the Examples 1-5, wherein the at least one coupling device is conductive.

Example 7 includes the antenna system of Example 6, wherein an electrical length of the at least one coupling device is less than 0.4 wavelengths and is selected such that vertically polarized radiation towards a horizon is enhanced.

Example 8 includes the antenna system of any of the Examples 1-7, wherein the at least one coupling device is formed from a printed circuit board having conductive features.

Example 9 includes the antenna system of any of the Examples 1-8, further including displacer material. The at least one coupling device is positioned in a cavity of the displacer material. A first end of the at least one coupling device is coupled to the printed circuit board and a second end of the coupling device secured to the displacer material.

Example 10 includes the antenna system of any of the Examples 1-9, wherein the at least one driven radiator element is a plurality of crossed-dipole elements and the at least one coupling device is a plurality of the coupling devices. Further wherein the plurality of the coupling devices are one of symmetrically positioned in relation to the plurality of cross-dipole elements and asymmetrically positioned in relation to the plurality of cross-dipole elements.

Example 11 is an antenna system with enhance gain at low elevations. The antenna system includes at least one driven radiator element, at least one coupling device and displacer material. The at least one driven radiator element is coupled to a printed circuit board. The at least one coupling device is associated with each driven radiator element. Each coupling device includes a first end and a second end. The first end is coupled to at least one ground layer through a connecting passage of the printed circuit board. The at least one coupling device is received with a cavity of the displacer material. The second end of the coupling device is attached to the displacer material.

Example 12 is an antenna system including Example 11, further including an adhesive used to attached the second end of the at least one coupling device to the displacer material.

Example 13 includes the antenna system of any of the Examples 11-12, wherein the second end of the at least one coupling device has a point that is received in a ceiling of the cavity to the displacer material to attach the second end of the at least one coupling device to the displacer material.

Example 14 includes the antenna system of any of the Examples 11-13, wherein the displacer material is a foam air displacer material.

Example 15 includes the antenna system of any of the Examples 11-14, wherein the at least one coupling device is a made from a conductive material.

Example 16 includes the antenna system of any of the Examples 11-15, wherein the at least one coupling device further includes a base post and a conductive trace. The base post is made of a laminate material. The conductive trace is electrically coupled to the at least one ground layer.

Example 17 includes the antenna system of any of the Examples 11-16, wherein the at least one coupling device includes a step feature that reduces a size of the first end of the at least one coupling device to allow the first end to be received within the connecting passage of the printed circuit board while a ledge formed by the step feature engages a connecting pad of the printed circuit board.

Example 18 is an antenna system with enhance gain at low elevations. The antenna system includes a plurality of cross-dipole elements, a plurality of coupling devices, at least one solder joint and displacer material. The plurality of cross-dipole elements form an array of radiating elements that are coupled to a printed circuit board. The plurality of coupling devices are associated with each cross-dipole element. Each coupling device has a first end and a second end. Each coupling device further has a step feature in at least one of width and diameter. A smaller of the at least one of the width and diameter proximate the first end of each coupling device is received in a connection passage in the printed circuit board. The at least one solder joint couples each coupling device to a connection pad associated with a connection passage of the printed circuit board. The at least one coupling device is received within a cavity of the displacer material. The second end of each coupling device is attached to the displacer material.

Example 19 includes the antenna system of Example 18, further including an adhesive used to attach the second end of each coupling device to the displacer material.

Example 20 includes the antenna system and any of the Example 18-19, wherein the second end of the at least one coupling device has a point that is received in a ceiling of the cavity to the displacer material to attach the second end of each coupling device to the dispenser material.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. An antenna system comprising:

a printed circuit board;

at least one driven radiator element disposed above the printed circuit board;

at least one coupling device having a step feature in at least one of width and diameter, a smaller of the at least one of the width and diameter of the at least one coupling device received in at least one of a via and slot in the printed circuit board, the at least one coupling device being oriented nominally orthogonal to a plane of the printed circuit board;

at least one solder joint coupling the at least one coupling device to the printed circuit board; and at least one ground plane layer electrically connected to the at least one coupling device by at least one of the solder joint and the at least one of a via and a slot.

2. The antenna system of claim 1, wherein the antenna system is circularly polarized.

3. The antenna system of claim 1, wherein the at least one driven radiator element is at least one a crossed-dipole element.

4. The antenna system of claim 3, wherein the at least one crossed-dipole element has four active arms and four passive arms.

5. The antenna system of claim 1, wherein the at least one coupling device has one of a nominally circular cross-section and a rectangular cross section.

6. The antenna system of claim 1, wherein the at least one coupling device is conductive.

7. The antenna system of claim 6, wherein an electrical length of the at least one coupling device is less than 0.4 wavelengths and selected such that vertically polarized radiation towards a horizon is enhanced.

8. The antenna system of claim 1, wherein the at least one coupling device is formed from a printed circuit board having conductive features.

9. The antenna system of claim 1, further comprising:

displacer material, the at least one coupling device positioned in a cavity of the displacer material, a first end of the at least one coupling device coupled to the printed circuit board and a second end of the coupling device secured to the displacer material.

10. The antenna system of claim 1, wherein:

the at least one driven radiator element is a plurality of crossed-dipole elements; and the at least one coupling device is a plurality of the coupling devices, further wherein the plurality of the coupling devices are one of symmetrically positioned in relation to the plurality of cross-dipole elements and asymmetrically positioned in relation to the plurality of cross-dipole elements.

11. An antenna system with enhance gain at low elevations, the antenna system comprising:

at least one driven radiator element coupled to a printed circuit board;

at least one coupling device associated with each driven radiator element, each coupling device including a first end and a second end, the first end coupled to at least one ground layer through a connecting passage of the printed circuit board; and displacer material, the at least one coupling device received with a cavity of the displacer material, the second end of the coupling device attached to the displacer material.

12. The antenna system of claim 11, further comprising:

an adhesive used to attached the second end of the at least one coupling device to the displacer material.

13. The antenna system of claim 11, wherein the second end of the at least one coupling device has a point that is received in a ceiling of the cavity to the displacer material to attach the second end of the at least one coupling device to the displacer material.

14. The antenna system of claim 11, wherein the displacer material is a foam air displacer material.

15. The antenna system of claim 11, wherein the at least one coupling device is a made from a conductive material.

16. The antenna system of claim 11, wherein the at least one coupling device further comprises:

a base post of laminate material; and a conductive trace, the conductive trace electrically coupled to the at least one ground layer.

17. The antenna system of claim 11, wherein the at least one coupling device includes a step feature that reduces a size of the first end of the at least one coupling device to allow the first end to be received within the connecting passage of the printed circuit board while a ledge formed by the step feature engages a connecting pad of the printed circuit board.

18. An antenna system with enhance gain at low elevations, the antenna system comprising:

a plurality of cross-dipole elements forming an array of radiating elements coupled to a printed circuit board;

a plurality of coupling devices associated with each cross-dipole element, each coupling device having a first end and a second end, each coupling device further having a step feature in at least one of width and diameter, a smaller of the at least one of the width and diameter proximate the first end of each coupling device is received in a connection passage in the printed circuit board;

at least one solder joint coupling each coupling device to a connection pad associated with a connection passage of the printed circuit board; and displacer material, the at least one coupling device received within a cavity of the displacer material, the second end of each coupling device attached to the displacer material.

19. The antenna system of claim 18, further comprising:

an adhesive used to attach the second end of each coupling device to the displacer material.

20. The antenna system of claim 18, wherein the second end of the at least one coupling device has a point that is received in a ceiling of the cavity to the displacer material to attach the second end of each coupling device to the dispenser material.

* * * * *